US008734549B2

(12) United States Patent
Kyo et al.

(10) Patent No.: US 8,734,549 B2
(45) Date of Patent: May 27, 2014

(54) METHOD FOR GASIFYING SOLID FUEL WITH UNIFIED GAS PURIFICATION AND GASIFIER USING SAID METHOD

(75) Inventors: Koubun Kyo, Tokyo (JP); Takahiro Murakami, Tokyo (JP); Toshiyuki Suda, Tokyo (JP); Shigeru Kusama, Tokyo (JP); Toshiro Fujimori, Tokyo (JP)

(73) Assignee: IHI Corporation, Tokyo (JP)

( * ) Notice: Subject to any disclaimer, the term of this patent is extended or adjusted under 35 U.S.C. 154(b) by 18 days.

(21) Appl. No.: 13/401,493

(22) Filed: Feb. 21, 2012

(65) Prior Publication Data

US 2012/0167467 A1 Jul. 5, 2012

Related U.S. Application Data

(62) Division of application No. 11/916,365, filed as application No. PCT/JP2006/305785 on Mar. 23, 2006, now abandoned.

(30) Foreign Application Priority Data

Jul. 5, 2005 (JP) ..... 2005-195945

(51) Int. Cl.
*C01B 3/36* (2006.01)

(52) U.S. Cl.
USPC ..... 48/197 R

(58) Field of Classification Search
None
See application file for complete search history.

(56) References Cited

U.S. PATENT DOCUMENTS

| | | | | |
|---|---|---|---|---|
| 3,115,394 | A | 12/1963 | Gorin et al. | |
| 4,162,963 | A * | 7/1979 | Gorin | 208/108 |
| 4,231,760 | A | 11/1980 | Lancet et al. | |
| 4,359,451 | A | 11/1982 | Tipton | |
| 4,568,362 | A | 2/1986 | Deglise et al. | |
| 2004/0237404 | A1 | 12/2004 | Andrus, Jr. et al. | |
| 2004/0237405 | A1 * | 12/2004 | Takeuchi et al. | 48/197 FM |
| 2006/0096298 | A1 * | 5/2006 | Barnicki et al. | 60/781 |

FOREIGN PATENT DOCUMENTS

| | | |
|---|---|---|
| AU | 405937 | 2/2004 |
| JP | 2004-59816 | 2/2004 |
| WO | WO 01/42132 A1 | 6/2001 |
| WO | WO 02/38706 A1 | 5/2002 |

* cited by examiner

*Primary Examiner* — Imran Akram
(74) *Attorney, Agent, or Firm* — Oblon, Spivak, McClelland, Maier & Neustadt, L.L.P.

(57) ABSTRACT

A gasification process is divided into three processes: a gasification furnace for carrying out gasification process by pyrolysis and gasification (pyrolysis gasification phase, first process), a combustion furnace for burning char to obtain calcined active chemical (char combustion phase, second process) and a gas purification furnace for purifying gasified gas (gasified gas purification phase, third process). Through heat transmission by the fluid heat medium and chemical reactions in respective phases by the chemical, the gasification furnace is independently controlled to a low or medium temperature (773-1073 K) which is required for gasification and which enables absorption of $CO_2$; and the gas purification furnace is controlled to a high temperature (1073 K or more) required for gas purification.

6 Claims, 7 Drawing Sheets

METHOD FOR GASIFYING SOLID FUEL WITH UNIFIED GAS PURIFICATION AND GASIFIER USING SAID METHOD

CROSS-REFERENCE TO RELATED APPLICATIONS

This application is a division of U.S. patent application Ser. No. 11/916,365 filed Dec. 3, 2007, the entire contents of which is incorporated herein by reference. U.S. patent application Ser. No. 11/916,365 is a National Stage of PCT/JP06/305785 filed Mar. 23, 2006 and claims the benefit of priority from prior Japanese Patent Application No. 2005-195945 filed Jul. 5, 2005.

TECHNICAL FIELD

The present invention relates to technique for gasifying solid fuel, and more specifically relates to technique for gasifying solid fuel highly efficiently and more cleanly.

BACKGROUND ART

Gasification of solid fuel such as coal, biomass or various wastes in a gasification furnace is generally carried out in a high-temperatured environment of about 1123 K or more so as to obtain sufficient reaction speed and heat supply to the reaction. In order to attain such high-temperatured environment of about 1123 K or more in the gasification furnace, part of the solid fuel itself must be burned.

However, such combustion of the solid fuel itself disadvantageously deteriorates gasification efficiency of the fuel. To carry out the combustion and gasification of the fuel in one and the same reaction space or gasification furnace inevitably causes a large amount of inert gases such as $CO_2$ and $N_2$ to be admixed in the gasified gas, resulting in lowering in purity and heat quantity of the product gas.

Moreover, the gas gasified in the high-temperatured environment is rich in CO and $CO_2$ and poor in $H_2$; in order to produce $H_2$-enriched product gas required, for example, for a synthesizing process of GTL (Gas to Liquid), the high-temperatured gasified gas must be cooled to independently carry out CO shift reaction and removal of $CO_2$.

A conventionally known method for concurrently removing CO during gasification of solid fuel is to absorb $CO_2$ in gasified gas in a gasification furnace, using a chemical such as CaO-based oxide; however, in a high-temperatured environment of 1123 K or more, there is a restriction in terms of chemical equilibrium that absorption of $CO_2$ requires the gasification furnace to be in a high pressure environment of 20 atm or more (see, for example, Patent References 1 and 2).

The gasification technique at such high pressure can be utilized practically only in large-scaled energy/fuel producing systems of several hundreds MW from a viewpoint of cost or other restrictions; in other various low-capacity systems such as a dispersed hydrogen fuel cell power and synthesis system, it has been desired that production of $H_2$-enriched product gas be carried out through gasification at low or preferably normal pressure.

Thus, it is conceivable that a gasification process with enabled high efficiency at low or medium temperature and at low pressure is indispensable for application to various energy-scale energy/fuel production systems including the above-mentioned GTL or in order to construct next-generation, highly effective electric generating systems.

More specifically, if gasification at low or medium temperature were put into practice, there would be no need of burning the solid fuel itself; instead, for example, various industrial waste heats such as heat of exhaust gas from a gas turbine may be utilized as heat source for gasification with expectation for high efficiency of the gasification. There would be no need of a high pressure environment; instead, for example even at a normal pressure, $CO_2$ in the gasified gas may be satisfactorily absorbed by oxide chemical such as CaO, providing that it is at low or medium temperature.

With respect to a method for gasifying fuel through combustion of solid fuel itself (usual partial oxidation method, other method of not using a gasifying agent or auto-thermal gasification method, or other method of using a gasifying agent such as steam or $CO_2$), a twin-circulating-fluidized-bed-type gasification technique is known (see, for example, Patent References 3 and 4) wherein inert gas such as $CO_2$ generated by combustion and $N_2$ fed through supply of air for combustion are prevented from being admixed in the gasified gas in such a manner that the solid fuel is gasified in the gasification furnace, the gasified char being burned in a combustion furnace separate from the gasification furnace, heat fluid medium being circulated between these gasification and combustion furnaces to transfer heat from the combustion furnace to the gasification furnace.

In such a gasification method with fuel gasification separate from char combustion and in order to absorb $CO_2$ in gasified gas to produce $H_2$-enriched product gas, there has been developed, in Europe, a gasification method called AER (Absorption Enhanced Reforming) wherein heat medium circulated between the combustion and gasification furnaces is added with CaO chemical (see Non-patent Reference 1). In the AER method, circulating fluidized bed is used; biomass is gasified in a gasification furnace adjacent to a downcomer in an environment of 873-973 K and at normal pressure, $CO_2$ being absorbed by CaO chemical to obtain gasified gas with high $H_2$ content and to accelerate the gasifying reaction, $CaCO_3$ thus generated being regenerated into CaO in a riser combustion furnace and being circulated to the gasification furnace together with the fluid heat medium.

[Patent Reference 1] U.S. Pat. No. 4,231,760
[Patent Reference 2] JP2004-59816A
[Patent Reference 3] U.S. Pat. No. 4,568,362
[Patent Reference 4] AT405937B
[Non-Patent Reference 1] http://www.aer-gas.de

SUMMARY OF THE INVENTION

Problems to be Solved by the Invention

In the existing gasification methods with separate combustion (char) and gasification (fuel), the gasification reaction is either at high temperature of 1123 K or more (Patent References 3 and 4) or at low or medium temperature of 973 K or so (AER).

The gasification at the low or medium temperature inevitably generates tar in large quantity. Although CaO is used as catalyst for reformation of tar in the above-mentioned AER, temperature as high as 1123 K or more is required for CaO to exhibit sufficient catalytic function to tar, as is generally known in the art. Disadvantageously, in low-temperature environment of 873-973 K as in AER, tar is not sufficiently reformed, i.e., the gasified gas is not sufficiently purified. Thus, it is predicted that the gasified gas obtained in the above-mentioned AER actually contains tar in large quantity.

On the other hand, in the case of the gasification reaction temperature of 1123 K or more, CaO-based chemical indeed exhibits sufficient catalytic function for reformation of tar in the gasified gas; however, at such high temperature, $CO_2$ cannot be sufficiently absorbed by CaO. As mentioned above, in order to bring about absorption of $CO_2$, the operation pressure of the gasification furnace must be set to as high as 20 atm or more, which causes problems that gasification in high-pressure environment is costly and that application of gasification technique is restricted.

Thus, in fact, a catalytic function of reforming tar in gasified gas through chemical such as CaO is not compatible with a function of absorbing $CO_2$ in gas to accelerate gasifying reaction.

The invention was made in order to solve the above problems and to make it possible that a function of absorbing $CO_2$ in gas by a chemical to accelerate gasifying reaction is compatible with a catalytic function of reforming tar in gasified gas generated by the gasifying reaction, and to provide a gasification method of solid fuel with unified gas purification with enabled high gasification efficiency and production of clean produced gas as well as a gasifier using said method.

Means or Measures for Solving the Problems

In order to attain the above-mentioned objects, according to a first aspect of the invention, the invention is directed to a method for gasifying solid fuel with unified gas purification, characterized in that it comprises a first process of feeding solid fuel and a gasifying agent to a first reactor for pyrolysis gasification where said solid fuel is pyrolyzed in contact with a heat medium to generate char gasified by said gasifying agent, $CO_2$ in gasified gas generated by said pyrolysis and gasification being absorbed by active chemical at a reaction temperature of said pyrolysis gasification; a second process of feeding residual char which was not gasified in said reactor of pyrolysis gasification phase, the heat medium is low-temperatured by the pyrolysis and gasification of said solid fuel, the low-active chemical is less-activated through reaction with said $CO_2$ and newly added inactive chemical to a second reactor for char combustion where said char is burned by an oxidizing agent to bring about combustion heat with which said low-temperatured heat medium is heated, said low-active and inactive chemicals are calcined to be re-activated and activated, respectively; and a third process of feeding the heat medium heated in said second reactor for char combustion and the active chemical activated as well as said gasified gas from said first reactor for pyrolysis gasification to a third reactor for gasified gas purification where said active chemical functions as a catalyst to reform tar in said gasified gas at a reaction temperature of said gasified gas purification and absorbs $H_2S$ and HCl in said gasified gas to purify said gasified gas, the active chemical functioning as catalyst to purify said gasified gas being circulated together with the heat medium to said first reactor for pyrolysis gasification.

Thus, in the second reactor for char combustion, the heat medium is heated and the low-active and newly added inactive chemicals are calcined to generate the active chemical (second process), the high-temperatured heat medium and active chemical being fed to the third reactor for gasified gas purification where, at the high reaction temperature of the gasified gas purification, tar in the gasified gas is satisfactorily reformed with the active chemical functioning as a catalyst, and $H_2S$ and HCl in the gasified gas are satisfactorily absorbed by the active chemical (third process). Then, the chemical having reformed the heat medium and tar and having absorbed $H_2S$ and HCl is circulated to the first reactor for pyrolysis gasification while it possesses absorption activity of $CO_2$; in the first reactor for pyrolysis gasification, $CO_2$ in gasified gas generated by the pyrolysis and gasification of the solid fuel is satisfactorily absorbed by the chemical at the low or medium reaction temperature of the pyrolysis gasification (first process).

In the first process, the reaction temperature in the first reactor for pyrolysis gasification for said pyrolysis gasification is set to 773-1073 K suitable for the absorption reaction of $CO_2$ in the gasified gas by the active chemical.

Thus, the reaction temperature of the pyrolysis and gasification in said first reactor for pyrolysis gasification is suitable for the absorption reaction of $CO_2$ in the gasified gas by the active chemical so that it is maintained to the low or medium temperature of 773-1073 K at which $CO_2$ in the gasified gas can be satisfactorily absorbed by the active chemical, so that even if the first reactor for pyrolysis gasification is substantially at normal pressure, $CO_2$ in the gasified gas generated by gasification is reliably absorbed by the active chemical.

In the second process, the reaction temperature in said second reactor for char combustion can be set to 1073 K or more suitable for re-activation and activation reactions of the low-active and inactive chemicals, respectively.

Thus, the reaction temperature in the second reactor for char combustion is suitable for the re-activation and activation reactions of the low-active and inactive chemicals, respectively, and is maintained to high temperature of 1073 K or more so that the heat medium and active chemical are made sufficiently high-temperatured and the active chemical is sufficiently activated.

In the third process, the reaction temperature in said third reactor for gasified gas purification for said gasified gas purification can be set to the temperature of 1073 K or more suitable for sufficient exhibition of the catalytic function of the active chemical to the tar reforming reaction, which is lower than the reaction temperature in the second reactor for char combustion and higher than the reaction temperature in the first reactor for pyrolysis gasification for the pyrolysis gasification.

Thus, the reaction temperature in the third reactor for gasified gas purification for the gasified gas purification is suitable for exhibition of the catalytic function of the active chemical to the tar reforming reaction so that it is maintained at a high temperature of 1073 K or more at which tar in the gasified gas can be satisfactorily reformed by the active chemical; the tar in the gasified gas is reliably reformed by the active chemical and at the same time $H_2S$, HCl and the like are satisfactorily removed. In this case, owing to the more or less endotherm in the tar reforming reaction in the gasified gas purification, the high reaction temperature in said gasified gas purification is somewhat lowered than the reaction temperature in the char combustion, i.e., the temperature of the particles and active chemical heated in the char combustion, but is reliably higher than the low or medium reaction temperature in the first reactor for pyrolysis gasification.

The inactive chemical may be mineral which has a base of metal carbonate or hydroxide.

When the inactive chemical is mineral such as $Ca(OH)_2$ which has a base of metal carbonate such as $CaCO_3$ or hydroxide, then the activated active chemical such as CaO can satisfactorily absorb $CO_2$ in the gasified gas in the first reactor for pyrolysis gasification and at the low or medium reaction temperature of said pyrolysis gasification; and in the third reactor for gasified gas purification, it can suitably function as a catalyst to satisfactorily reform the tar in the gasified gas at a high reaction temperature of the gasified gas purification.

According to a second aspect of the invention, the invention is directed to a gasifier for solid fuel with unified gas purification, characterized in that it comprises a first reactor for pyrolysis gasification which is fed with the solid fuel and a gasifying agent, said solid fuel being pyrolyzed in contact with a heat medium to generate char gasified by said gasifying agent, $CO_2$ in gasified gas generated by said pyrolysis and gasification being absorbed by an active chemical at a reaction temperature of the pyrolysis and gasification; a second reactor for char combustion fed with residual which is char not gasified in said first reactor for pyrolysis gasification, the heat medium is low-temperatured by the pyrolysis and gasification of said solid fuel, the low-active chemical is less-activated through reaction with said $CO_2$ and newly added inactive chemical, said char being burned by an oxidizing agent to bring about combustion heat with which said low-temperatured heat medium is heated and said low-active and inactive chemicals are calcined to be re-activated and activated, respectively; and a third reactor for gasified gas purification which is fed with the heat medium heated in said second reactor for char combustion, the activated active chemical and said gasified gas from said first reactor for pyrolysis gasification, said active chemical functioning as catalyst to reform tar in said gasified gas at a tar reforming reaction temperature and absorbing $H_2S$ and HCl in said gasified gas to purify said gasified gas, the active chemical functioning as a catalyst to purify said gasified gas being circulated together with the heat medium to said reactor of pyrolysis gasification phase.

Thus, in the second reactor for char combustion, the heat medium is heated and the low-active and newly added inactive chemicals are calcined to generate an active chemical, so that the high-temperatured heat medium and active chemical are fed to the third reactor of gasified gas purification phase where tar in the gasified gas is satisfactorily reformed with the active chemical functioning as a catalyst at a high reaction temperature required for tar reformation and $H_2S$ and HCl in the gasified gas are satisfactorily absorbed by the active chemical. Then, the chemical having reformed the tar and absorbed $H_2S$ and HCl is circulated together with the heat medium to the first reactor for pyrolysis gasification while possessing the absorption activity of $CO_2$, and in the first reactor for pyrolysis gasification, $CO_2$ in the gasified gas generated by the pyrolysis and gasification of the solid fuel is satisfactorily absorbed by the chemical at the low or medium reaction temperature of the pyrolysis gasification required for absorption of $CO_2$.

The reaction temperature of the pyrolysis gasification in the first reactor for pyrolysis gasification can be set to 773-1073 K suitable for with the absorption reaction of $CO_2$ in the gasified gas by the active chemical.

Thus, the reaction temperature of the pyrolysis gasification in the first reactor for pyrolysis gasification is suitable for the absorption reaction of $CO_2$ in the gasified gas by the active chemical, so that it is maintained to the low or medium temperature of 773-1073 K at which $CO_2$ in the gasified gas can be satisfactorily absorbed by the active chemical. As a result, even if the first reactor for pyrolysis gasification is substantially at the normal pressure, $CO_2$ in the gasified gas generated by the gasification is reliably absorbed by the active chemical.

The reaction temperature in the second reactor for char combustion can be set to 1073 K or more suitable for the re-activation and activation reactions of the low-active and inactive chemicals, respectively.

Thus, the reaction temperature in the second reactor for char combustion is suitable for the re-activation and activation reactions of the low-active and inactive chemicals, respectively, so that it is maintained to 1073 K or more. As a result, the heat medium and active chemical are sufficiently high-temperatured and the active chemical is sufficiently activated.

The reaction temperature for tar reformation in the third reactor for gasified gas purification can be set to the temperature of 1073 K or more suitable for sufficient exhibition of the catalytic function of the active chemical to the tar reforming reaction, which is lower than the reaction temperature in the second reactor for char combustion and higher than the reaction temperature in the first reactor for pyrolysis gasification for the pyrolysis gasification.

Thus, the reaction temperature for tar reformation in the third reactor for gasified gas purification is suitable for exhibition of the catalytic function of the active chemical to the tar reforming reaction, so that it is maintained to the high temperature of 1073 K or more at which tar in the gasified gas can be satisfactorily reformed by the active chemical. As a result, the tar in the gasified gas is reliably reformed and at the same time $H_2S$, HCl and the like is satisfactorily removed by the active chemical. In this case, due to the more or less endotherm by the tar reforming reaction in the gasified gas purification, the high reaction temperature in the gasified gas purification is somewhat lower than the reaction temperature in the char combustion, i.e., the temperature of the particles and active chemical heated in the char combustion, but is reliably higher than the low or medium reaction temperature for the pyrolysis gasification in the first reactor for pyrolysis gasification.

The inactive chemical may be mineral which has a base of metal carbonate or hydroxide.

Thus, as the inactive chemical is mineral such as $Ca(OH)_2$ which has a base of metal carbonate such as $CaCO_3$ or hydroxide, the activated active chemical such as CaO can satisfactorily absorb $CO_2$ in the gasified gas in the first reactor for pyrolysis gasification at the low or medium reaction temperature for the pyrolysis and gasification and can suitably function as catalyst to sufficiently reform the tar in the gasified gas at the high temperature for tar reformation in the third reactor for gasified gas purification.

The third reactor for gasified gas purification may be larger in horizontal cross sectional area than the first reactor for pyrolysis gasification.

This prolongs the dwell time of the gasified gas in the third reactor for gasified gas purification, so that the gasified gas is sufficiently purified.

The third reactor for gasified gas purification may be arranged integral with the first reactor for pyrolysis gasification, and the particle passage for circulation of the heat medium and active chemical from the third reactor for gasified gas purification to the first reactor for pyrolysis gasification may be arranged inside or outside of the integrated third reactor for gasified gas purification and first reactor for pyrolysis gasification.

As a result, the integrated arrangement of the third reactor for gasified gas purification with the first reactor for pyrolysis gasification makes the apparatus compact in size, and the inside or outside arrangement of the particle passage from the third reactor for gasified gas purification to the first reactor for pyrolysis gasification phase stabilizes the circulation of the heat medium and active chemical.

Effects of the Invention

According to the method for gasifying solid fuel with unified gas purification in the first aspect of the invention, the whole process of gasifying the solid fuel is divided into three phases of pyrolysis gasification, char combustion and gasified gas purification. Tar in the gasified gas generated by the pyrolysis gasification of the solid fuel is reformed in the gasified gas purification at the high reaction temperature in said gasified gas purification by the active chemical. The active chemical functioning as a catalyst to reform the tar is circulated together with the heat medium to the pyrolysis gasification where, at the low or medium temperature in said pyrolysis gasification, $CO_2$ in the gasified gas is absorbed by the same active chemical. Further, in the char combustion, the heat medium is heated and the low-active and newly added inactive chemicals are calcined to be activated. As a result, by the active chemical which is circulated, $CO_2$ in the gasified gas can be sufficiently absorbed at a proper reaction temperature in the pyrolysis gasification and tar in the gasified gas can be sufficiently reformed at a proper reaction temperature in the gasified gas purification; and, in the char combustion, the low-active and inactive chemicals can be sufficiently activated before contribution to tar reformation.

In short, in the respective phases of pyrolysis gasification, char combustion and gasified gas purification, the reaction temperatures can be independently controlled for realization of maximum reaction performances, so that the action of accelerating the gasifying reaction through absorption of $CO_2$ in the gas by the chemical can be made compatible with the catalytic action of reforming the tar in the gasified gas generated by the gasifying reaction.

Thus, the gasification of the solid fuel can be realized at high efficiency and cleanly to obtain the gasified gas with high quality.

In the first reactor for pyrolysis gasification, suitable for the absorption reaction of $O_2$ in the gasified gas by the active chemical, the reaction temperature in said first reactor can be maintained to the low or medium temperature of 773-1073 K at which $CO_2$ in the gasified gas can be satisfactorily absorbed by the active chemical, so that even if the reactor of pyrolysis gasification phase is not at high pressure but substantially at normal pressure, $CO_2$ in the gasified gas generated by the gasification can be reliably absorbed by the active chemical.

In the second reactor for char combustion, suitable for the re-activation and activation reactions of the low-active and inactive chemicals, respectively, the reaction temperature can be maintained to high temperature of 1073 K or more, so that the temperature of heat medium and active chemical can be sufficiently raised and the active chemical can be sufficiently activated.

In the third reactor for gasified gas purification, suitable for exhibition of the catalytic function of the active chemical to the tar reforming reaction, the reaction temperature in said gasified gas purification can be maintained to high temperature of 1073 K or more at which tar in the gasified gas can be satisfactorily reformed by the active chemical, so that the tar in the gasified gas can be reliably reformed by the active chemical and at the same time $H_2S$, HCl and the like can be satisfactorily removed. In this case, owing to the more or less endotherm of the tar reforming reaction in said phase, the high reaction temperature in said gasified gas purification is somewhat lower than the reaction temperature in the char combustion, i.e., the temperature of the particles and active chemical heated in the char combustion, but can be reliably higher than the low or medium reaction temperature in the first reactor for pyrolysis gasification for said pyrolysis gasification.

The inactive chemical may be mineral such as $Ca(OH)_2$ which has a base of metal carbonate such as $CaCO_3$ or hydroxide, so that, in the first reactor for pyrolysis gasification phase, $CO_2$ in the gasified gas can be sufficiently absorbed by the activated active chemical such as CaO in the low or medium reaction temperature in said pyrolysis gasification, and in the third reactor of gasified gas purification, the tar in the gasified gas can be sufficiently reformed in the high reaction temperature in said gasified gas purification.

According to the gasifier for solid fuel with unified gas purification in the second aspect of the invention, just like the above-mentioned first aspect, the whole process of gasifying the solid fuel is divided into three phases of pyrolysis gasification, char combustion and gasified gas purification. By the active chemical which is circulated, $CO_2$ in the gasified gas can be sufficiently absorbed at a proper reaction temperature in the pyrolysis gasification and tar in the gasified gas can be sufficiently reformed at a proper reaction temperature in the gasified gas purification; and, in the char combustion, the low-active and inactive chemicals can be sufficiently activated before contribution to tar reformation.

In short, in the respective phases of pyrolysis gasification, char combustion and gasified gas purification, the reaction temperatures can be independently controlled for realization of maximum reaction performances, so that the action of accelerating the gasifying reaction through absorption of $CO_2$ in the gas by the chemical can be made compatible with the catalytic action of reforming the tar in the gasified gas generated by the gasifying reaction.

Thus, the gasification of the solid fuel can be realized at high efficiency and cleanly to obtain the gasified gas with high quality.

In the first reactor for pyrolysis gasification phase, suitable for the absorption reaction of $CO_2$ in the gasified gas by the active chemical, the reaction temperature in the pyrolysis gasification can be maintained to the low or medium temperature of 773-1073 K at which $CO_2$ in the gasified gas can be satisfactorily absorbed by the active chemical, so that even if the first reactor for pyrolysis gasification is not high pressure but substantially at normal pressure, $CO_2$ in the gasified gas generated by the gasification can be reliably absorbed by the active chemical.

In the second reactor for char combustion, suitable for the re-activation and activation reactions of the low-active and inactive chemicals, respectively, the reaction temperature can be maintained to high temperature of 1073 K or more, so that the temperature of the heat medium and the active chemical can be sufficiently raised and the active chemical can be sufficiently activated.

In the third reactor for gasified gas purification, suitable for exhibition of the catalytic function of the active chemical to the tar reforming reaction, the tar reforming reaction temperature can be maintained to a high temperature of 1073 K or more at which tar in the gasified gas can be satisfactorily reformed by the active chemical, so that the tar in the gasified gas can be reliably reformed by the active chemical and at the same time $H_2S$, HCl and the like can be satisfactorily reformed. In this case, owing to the more or less endotherm of the tar reforming reaction in said phase, the high reaction temperature in said gasified gas purification is somewhat lower than the reaction temperature in the char combustion, i.e., the temperature of the particles and active chemical heated in the char combustion, but can be reliably higher than the low or medium reaction temperature in the first reactor for pyrolysis gasification for said pyrolysis gasification.

The inactive chemical may be mineral such as $Ca(OH)_2$ which has a base of metal carbonate such as $CaCO_3$ or hydroxide, so that, in the first reactor for pyrolysis gasification, $CO_2$ in the gasified gas can be sufficiently absorbed by the activated active chemical such as CaO in the low or medium reaction temperature in said pyrolysis gasification, and in the third reactor for gasified gas purification, the tar in the gasified gas can be sufficiently reformed in the high reaction temperature for tar reformation.

The third reactor for gasified gas purification may be larger in horizontal cross sectional area than the first reactor for pyrolysis gasification, so that the dwell time of the gasified gas in the third reactor for gasified gas purification can be prolonged to sufficiently purify the gasified gas.

The third reactor for gasified gas purification may be arranged integral with the first reactor for pyrolysis gasification, so that the apparatus can be made compact in size. Moreover, the inside or outside arrangement of the particle passage from the third reactor of gasified gas purification to the first reactor of pyrolysis gasification can stabilize the circulation of the heat medium and active chemical.

Figure 1:
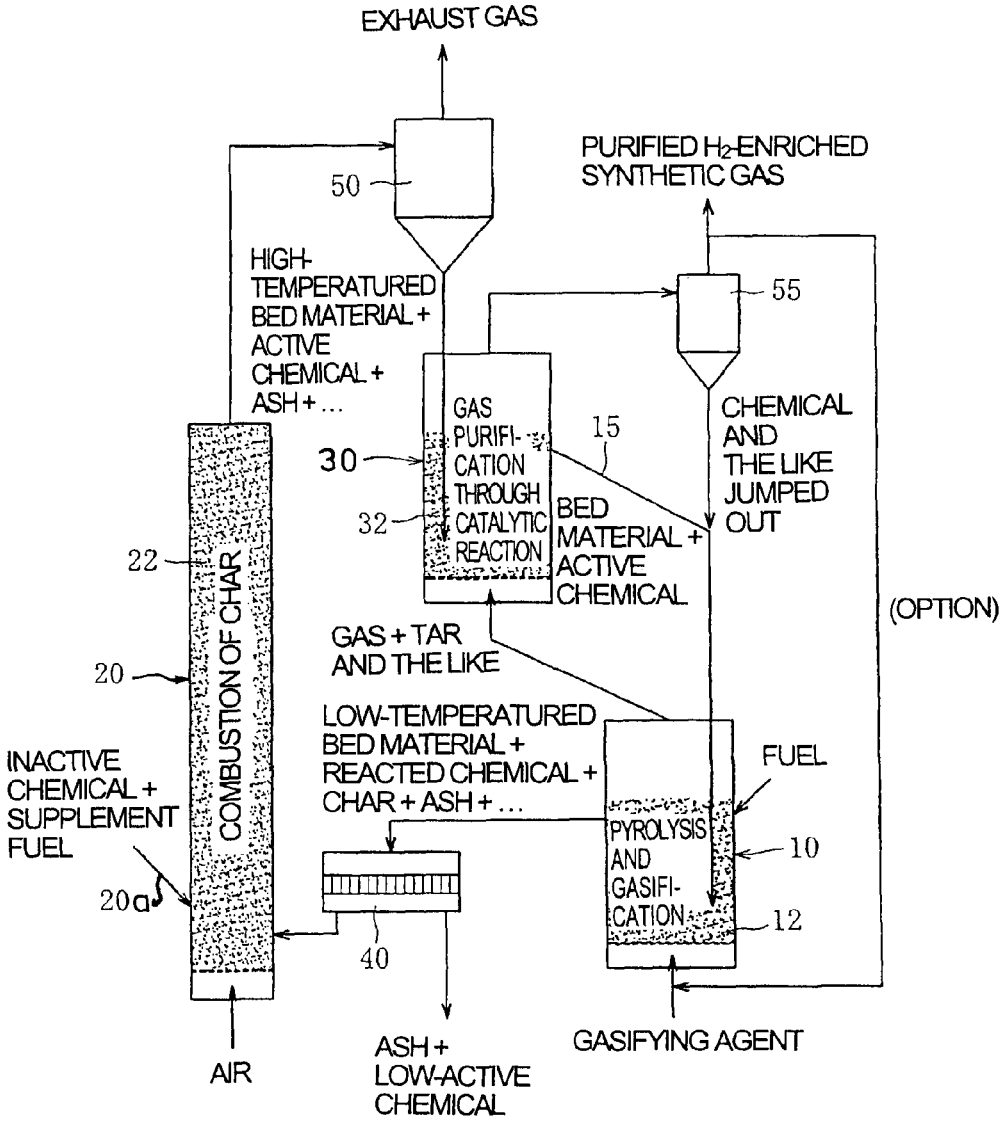
FIG. 1 A view showing schematic construction of a gasifier for solid fuel with unified gas purification according to a first embodiment of the invention.

| Explanation of the Reference Numerals | |
|---|---|
| 10 | gasification furnace (reactor for pyrolysis gasification) |
| 12 | fluidized bed |
| 14 | upper fluidized bed |
| 15, 15' and 15" | particle pipage (particle passage) |
| 20 | combustion furnace (reactor for char combustion) |
| 20a | chemical supply pipe (inactive chemical supply means) |
| 22 | fluidized bed |
| 30 | gas purification furnace (reactor for gasified gas purification) |
| 32 | fluidized bed |
| 40 | particle classifier (discharge means) |

BEST MODE FOR CARRYING OUT THE INVENTION

Next, embodiments of the invention will be described in conjunction with accompanying drawings.

Embodiment 1

First of all, a first embodiment will be described.

FIG. 1 shows schematic construction of a gasifier for solid fuel with unified gas purification according to the first embodiment of the invention. The description will be made in conjunction with FIG. 1.

The gasifier using the method for gasifying solid fuel with unified gas purification according to the invention is constructed as a system with an external circulation type fluidized bed, which separately comprises, as shown in FIG. 1, a gasification furnace (reactor for pyrolysis gasification) 10, a combustion furnace (reactor for char combustion) 20 and a gas purification furnace (reactor for gasified gas purification) 30, solid components being circulated through the furnaces 10, 20 and 30 together with fluid heat medium (bed material such as sand).

The gasification furnace 10 is a device with a fluidized bed 12 fed with solid fuel such as coal, biomass or various wastes and with a gasifying agent such as steamer or $CO_2$ for gasification (including pyrolysis) of the solid fuel through heat of the fluid heat medium heated and high-temperatured as mentioned hereinafter. The gasification furnace 10 is communicated at its top with the gas purification furnace 30, so that product gas (produced or gasified gas) gasified in the furnace 10 is fed to the gas purification furnace 30.

The gasification furnace 10 is communicated at its side center through a particle classifier 40 with a lower portion of the combustion furnace 20. The particle classifier 40 serves to separate ash of the solid fuel and part of low-active chemical mentioned hereinafter, char generated through the gasification and the low-temperatured fluid heat medium and has a function of discharging and discarding the ash of the solid fuel (the ash generated by char combustion in the combustion furnace 20) and part of low-active chemical mentioned hereinafter and a function of feeding the char, the part of the low-active chemical and the fluid heat medium to a lower portion of the combustion furnace 20.

The combustion furnace 20 is a device with a fluidized bed 22 fed with an oxidizing agent (air or $O_2$) from below for burning the char fed from the gasification furnace 10 and heating the fluid heat medium into high temperature, the furnace 20 being communicated at its top with a cyclone 50. The cyclone 50 is a device for separating the solid components from the gaseous components and has a function of discharging exhaust gas generated in the combustion furnace 20 into atmosphere and a function of feeding the high-temperatured fluid heat medium and solid components entrained in the exhaust gas to the gas purification furnace 30.

The combustion furnace 20 is provided with a chemical supply pipe (inactive chemical supply means) 20*a* which feeds chemical with its inactive state (inactive chemical or chemical agent) such as limestone ($CaCO_3$) to the fluidized bed 22.

The gas purification furnace 30 is a device for purifying the product gas fed from the gasification furnace 10 and is constructed to be capable of reforming tar in the product gas and absorbing and removing $H_2S$, HCl and the like in the product gas.

The gas purification furnace 30 is communicated at its top with a cyclone 55. The cyclone 55 is a device for separating the solid components from the gaseous components just like the cyclone 50 and has a function of feeding the product gas purified in the gas purification furnace 30, for example, as fuel to a gas turbine or the like and a function of returning the solid components entrained in the product gas to the gasification furnace 10.

A particle pipage 15 (particle passage) extends from a side center of the gas purification furnace 30 into the gasification furnace 10, whereby particles mainly constituted by the fluid heat medium are fed through the pipage 15 to the furnace 10.

The description will be made on mode of operation of the thus constructed gasifier using the gasification method with unified gas purification and the method for purifying gasified gas of solid fuel according to the invention.

Figure 2:
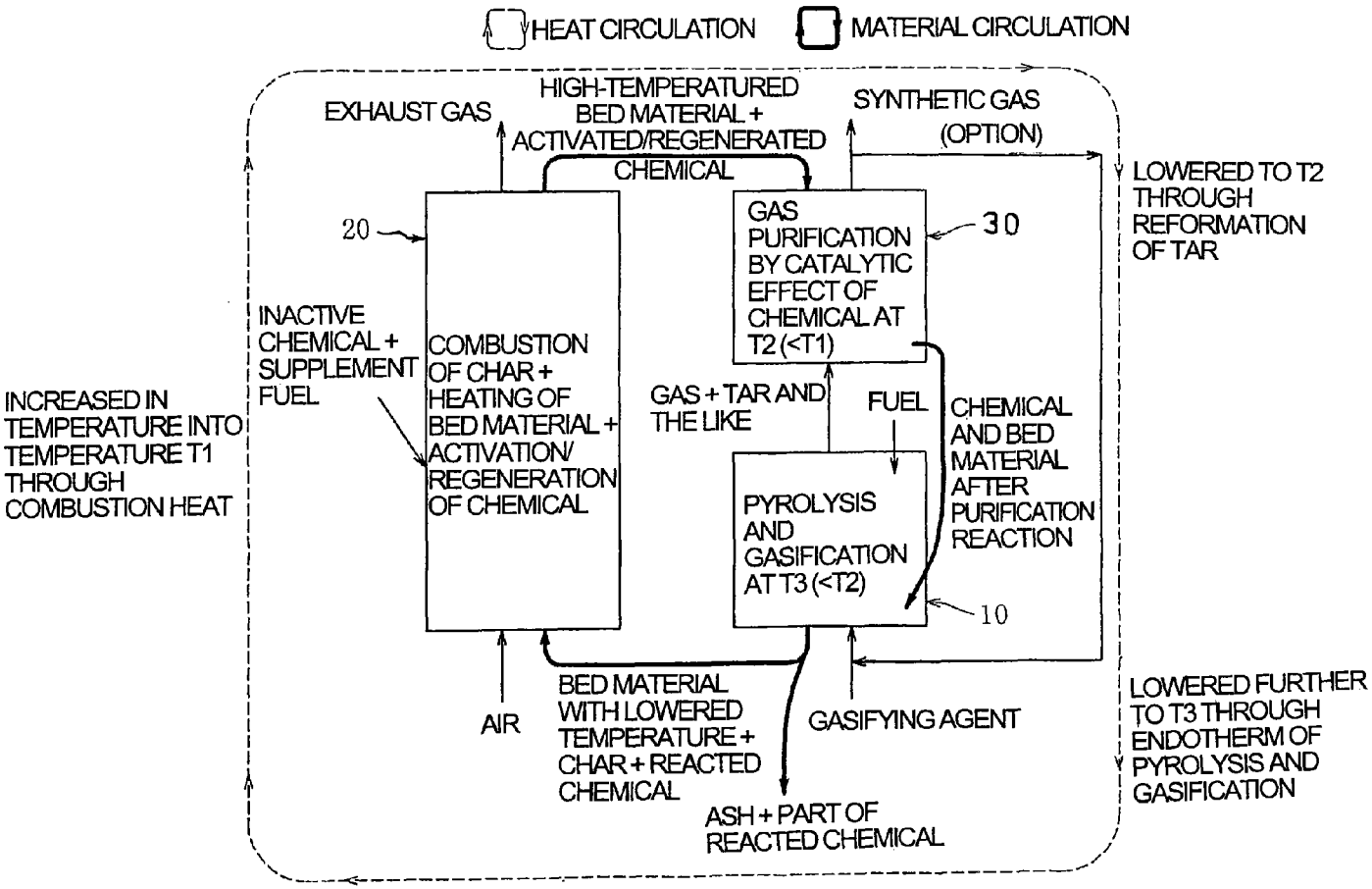
FIG. 2 A diagram schematically showing an operational principle of the method for gasifying solid fuel with unified gas purification according to the invention.

FIG. 2 schematically shows an operational principle of the method for gasifying solid fuel with unified gas purification according to the invention. The description hereinafter is referred also to the figure. In FIG. 2, solid arrows conceptually show material circulation of gas, fluid heat medium, chemical and the like and dotted arrows, heat circulation.

As mentioned in the above, the combustion furnace 20 is fed with the char from the gasification furnace 10 and with the oxidizing agent, and the char is burned. In this connection, the fluidized bed 22 in the furnace 20 is fed with chemical such as limestone ($CaCO_3$), $CaCO_3$ or the like being heated together with the fluid heat medium by combustion heat of the char. More specifically, the combustion of the char lacks endothermic reaction unlike the gasification of the solid fuel in the gasification furnace 10, so that the temperature in the combustion furnace 20 is satisfactorily increased to high temperature T1 (for example, 1073 K or more) in harmony with $CaCO_3$ degradation chemical reaction with formula (16) shown in table 1 below. In table 1, plus (+) and minus (−) indicate endothermic and exothermic amounts, respectively, for $\Delta H_0$.

TABLE 1

| phase | main reactions | $\Delta H_0$ (KJ) | roles |
|---|---|---|---|
| pyrolysis/ | (1)$C_mH_nO_x \rightarrow C + CO + H_2 + CO_2 + \ldots$ | $\Delta H_0 > 0$ | fuel pyrolysis |
| gasification | (2)$C + H_2O \rightarrow CO + H_2O$ | +131.3 | gasification of steam |
| (gasification | (3)$C + CO_2 \rightarrow 2CO$ | +172.5 | gasification of $CO_2$ |
| furnace) | (4)$CO + H_2O \rightarrow CO_2 + H_2$ | −41.2 | CO shift |
| (973 ± 50K) | (5)$CO_2 + CaO \rightarrow CaCO_3$ | −170.4 | Absorption of $CO_2$ |
| | (6)$C + 2H_2 \rightarrow CH_4$ | −74.9 | methanation of C |
| | (7)$CO + 3H_2 \rightarrow CH_4 + H_2O$ | −206.2 | methanation of CO |
| | (8)$CO_2 + 4H_2 \rightarrow CH_4 + 2H_2O$ | −165.0 | methanation of $CO_2$ |
| | (9)$CaO + H_2O \rightarrow Ca(OH)_2$ | −109.0 | hydration of chemical |
| | (10)$H_2S + CaO \rightarrow CaS + H_2O$ | $\Delta H_0 < 0$ | absorption of $H_2S$ |
| | (11)$2HCl + CaO \rightarrow CaCl_2 + CO$ | $\Delta H_0 > 0$ | absorption of HCl |
| gas purification | (12)$tar + H_2O \rightarrow CO + H_2 + CO_2 + \ldots$ | $\Delta H_0 > 0$ | reformation of tar |
| (gas purification | (13)$H_2S + CaO \rightarrow CaS + H_2O$ | $\Delta H_0 < 0$ | absorption of $H_2S$ |
| furnace) (about | (14)$2HCl + CaO \rightarrow CaCl_2 + H_2O$ | $\Delta H_0 > 0$ | absorption of HCl |
| 1123K) | | | |
| combustion of | (15)$C + O_2 \rightarrow CO_2$ | −393.5 | combustion of char |
| char (≥1123K) | (16)$CaCO_3 \rightarrow CaO + CO_2$ | +170.4 | calcining of $CaCO_3$ |
| | (17)$2CaS + O_2 \rightarrow 2CaO + SO_2$ | $\Delta H_0 > 0$ | regeneration of CaS |

The combustion of the char is carried out differently from the gasification of the solid fuel, so that a $CO_2$ content in the gasified gas is lower than that in a usual gasification furnace where combustion and gasification coexist; thus, $CO_2$ concentration in the combustion furnace 20 is suppressed to a value as low as, for example, 10-15 mol % or so whereas that in the usual gasification furnace is 20 mol % or more.

Thus, in the combustion furnace 20, $CaCO_3$ or the like is satisfactorily pyrolyzed at high temperature and with less $CO_2$ as shown by chemical formula (16) in table 1, resulting in satisfactory calcination of the active chemical such as CaO (second process).

Figure 3:
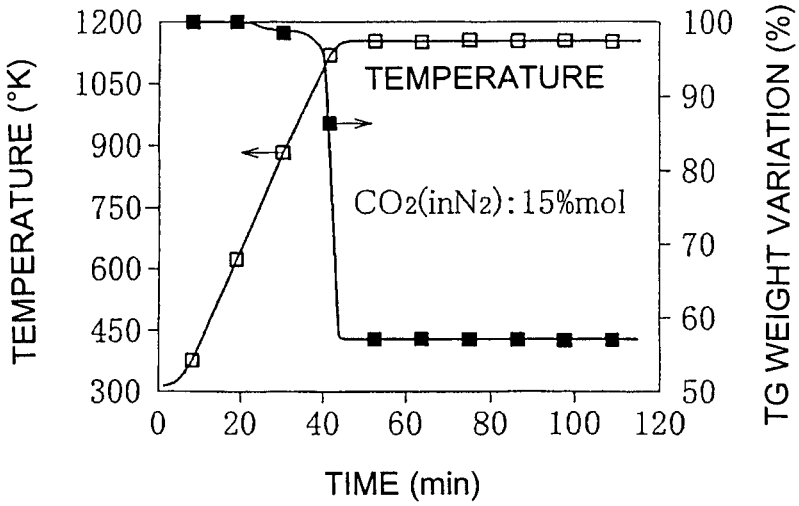
FIG. 3A graph showing thermo gravimetric (TG) weight variation of $CaCO_3$ when temperature is varied with a lower $CO_2$ concentration.

FIG. 3 shows weight variation (thermo gravimetric (TG) weight variation) in TG calcination of $CaCO_3$ when the temperature is varied with a low $CO_2$ concentration. It is seen from the figure that, if $CO_2$ concentration is low (for example, 15 mol %), $CaCO_3$ starts to be calcined at temperature of 1050 K or so, whereby CaO is satisfactorily calcined as shown by chemical formula (16). The reaction conditions of the $CO_2$ concentration being 15 mol % and temperature being 1050 K or more are just satisfied by atmosphere in the combustion furnace 20.

The thus calcined active chemical such as CaO is fed together with the high-temperatured fluid heat medium via the cyclone 50 to the gas purification furnace 30 which is also fed with product gas gasified in the gasification furnace 10.

In the gas purification furnace 30, the product gas gasified in the gasification furnace 10 is purified by the catalytic action of the above-mentioned active chemical such as CaO.

More specifically, in the gas purification furnace 30, gas purification chemical reactions such as formulae (12)-(14) shown in Table 1 proceed by heat of the fluid heat medium and active chemical such as CaO. Here, because of less reaction heat, the reaction temperature (reaction temperature in the phase, reaction temperature of reformation of tar) T2 in the fluidized bed 32 is as high as 1073 K or more and is substantially equal to the temperature of the particles from the cyclone 50, the catalytic function of the active chemical such as CaO to the tar reforming reaction formula (12) being sufficiently exhibited. The more or less endotherm in the tar reforming reaction formula (12) somewhat lowers the temperature of the particles passing through the gas purification furnace 30, so that actually the reaction temperature T2 is somewhat lower than the above-mentioned T1 in the combustion furnace 20.

Thus, with the product gas containing tar, dust, $H_2S$, HCl and the like, the fluidized bed 32 in the gas purification furnace 30 is maintained to high temperature (>1073 K) necessary to sufficiently exhibit and suitable for the catalytic function of the active chemical to the tar reforming reaction formula (12), so that CaO or the like sufficiently exhibits the catalytic function to tar and dust (reformation of tar) or exhibit attaching function (attachment of tar and dust) and can clarify them. Moreover, CaO or the like exhibits oxidation function as oxidizing agent to $H_2S$, HCl and the like and can absorb them. As a result, in the gas purification furnace 30, tar, dust, $H_2S$, HCl and the like in the product gas are sufficiently removed by CaO or the like, so that the product gas is sufficiently purified (third process).

Then, CaO or the like after the purification reaction and used in the purification of the product gas is circulated together with the fluid heat medium via the particle pipage 15 to the gasification furnace 10. CaO or the like jumped together with the product gas out of the gas purification furnace 30 also undergoes the solid-gas separation by the cyclone 55 and is fed to the gasification furnace 10.

In the gasification furnace 10, in the presence of heat from the fluid heat medium and CaO or the like, the chemical reactions of formulae (1)-(11) shown in table 1 above proceed through intervention of the $CO_2$ absorption activity of the chemical such as CaO; fuel pyrolysis and char gasification of formulae (1)-(3), which are highly endothermic reactions, further lowers the temperature of the above-mentioned solid matters (particles) from the gas purification furnace 30 than the above-mentioned reaction temperature T2. Then, at reaction pressure of as low as 1-5 atm and suitable for $CO_2$ absorption reaction (5), for example control of fuel treated amount is carried out to control the reaction temperature in the fluidized bed 12 to the reaction temperature T3 (for example 773-1073 K, more preferably 873-1023 K), i.e., to the low or medium temperature necessary for absorptive chemical reaction of $CO_2$.

Thus, in the gasification furnace 10, in the environment of low pressure and the required low or medium temperature T3, the solid fuel is gasified and CaO or the like is reacted with $CO_2$ for sufficient absorption of $CO_2$.

Figure 4:
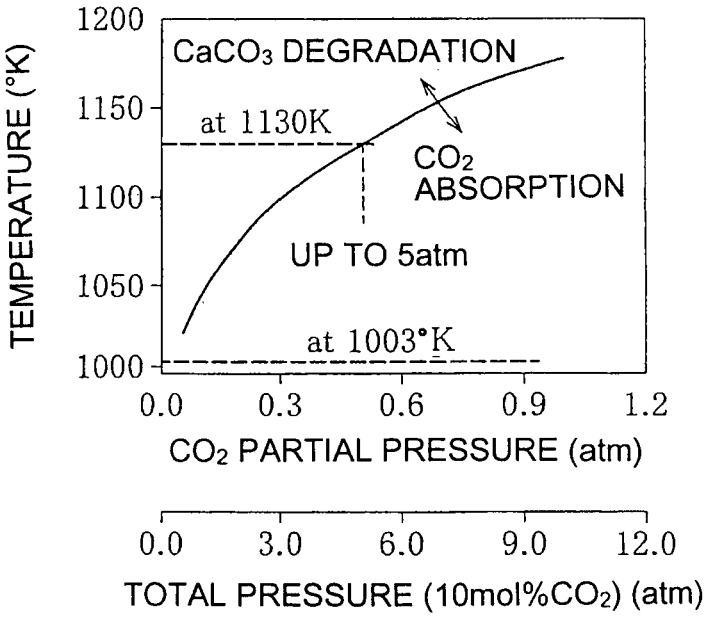
FIG. 4A graph showing chemical equilibrium on the basis of pressure and temperature in the chemical reaction of CaO with $CO_2$.

More specifically, in the chemical reaction of CaO with $CO_2$, chemical equilibrium as shown in FIG. 4 exists on the basis of pressure and temperature; if interior of the gasification furnace 10 is at low pressure (for example, 1-5 atm) or even at a normal pressure (1 atm), to maintain the gasification furnace 10 at the low or medium temperature T3 (for example, 873-1023 K) enables CaO to satisfactorily absorb $CO_2$, and the reaction in the reaction formula (5) in table 1 can be satisfactorily brought about.

Figure 5:
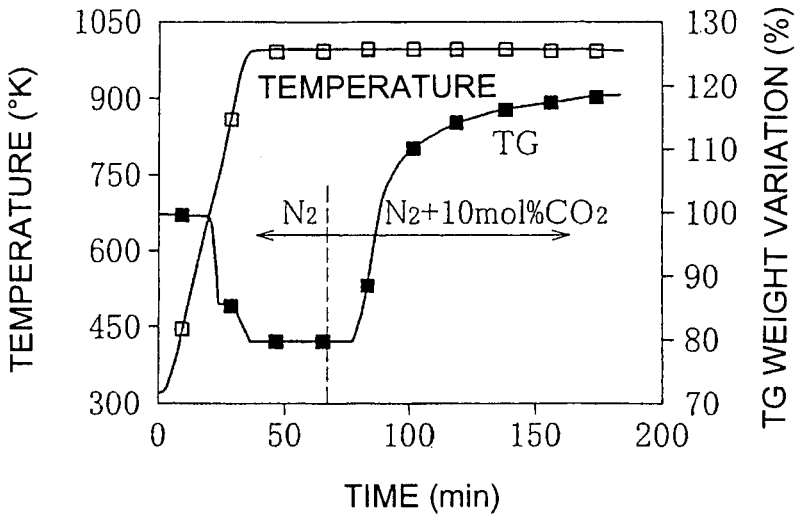
FIG. 5A graph showing TG weight variation of CaO when atmosphere temperature is increased to about 1000 K at normal pressure and in the presence of lower $CO_2$ concentration.
Figure 6:
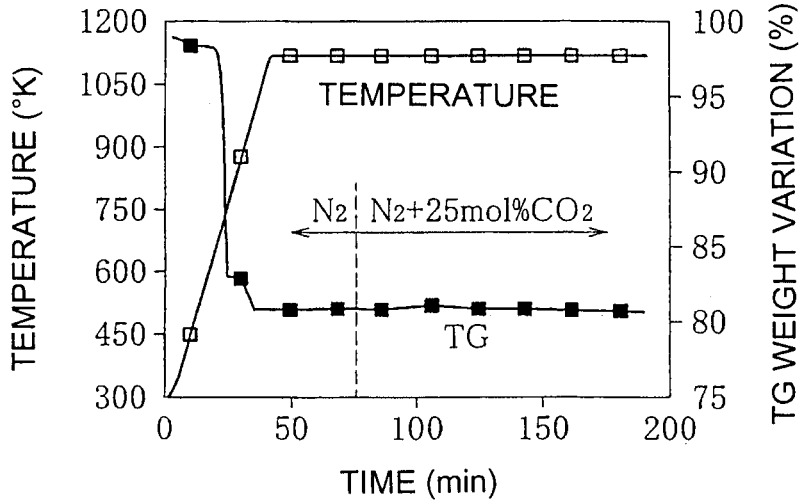
FIG. 6A graph showing TG weight variation of CaO when atmosphere temperature is increased to about 1130 K at normal pressure and in the presence of higher $CO_2$ concentration.

FIG. 5 shows weight variation (thermo gravimetric or TG weight variation) of CaO when atmosphere temperature is increased to about 1000 K at normal pressure and in the presence of 10 mol % of $CO_2$; and FIG. 6 shows, as comparative example, weight variation (TG weight variation) of CaO when atmosphere temperature is increased to about 1130 K at normal pressure and in the presence of 25 mol % of $CO_2$. It is apparent from these figures that the weight of CaO, which does not vary at high temperature of about 1130 K even with high $CO_2$ partial pressure, is drastically increased at the low or medium temperature of about 1000 K in the case of lower $CO_2$ partial pressure and that CaO is satisfactorily converted into $CaCO_3$ in the latter temperature condition.

Thus, in the gasification furnace 10, the active chemical such as CaO is satisfactorily reacted with $CO_2$ in the product gas to absorb $CO_2$, and is converted back into inactive chemical such as $CaCO_3$, i.e., returned into the original chemical.

As $CO_2$ is removed from the product gas in this manner, combustion heat amount possessed by the product gas is enhanced and $H_2$ concentration in the product gas is enhanced ($H_2$-enrichment). Moreover, absorption of $CO_2$ by CaO or the like is thermolysis reaction so that gasifying reaction speed is accelerated. Moreover, such temperature control of the fluidized bed 12 in the gasification furnace 10 contributes to stabilizing heat supply for gasification (including fuel pyrolysis) (first process).

When the active chemical such as CaO is reacted with $CO_2$ into low-active chemical such as $CaCO_3$, then part of regenerable $CaCO_3$ or the like is fed again, together with the char and the temperature of the fluid heat medium is lowered by the fuel gasifying reaction, to the combustion furnace 20 and thus is activated again and regenerated, as mentioned above, into CaO or the like.

CaS or the like, which is generated when CaO or the like is used for oxidation of $H_2S$ or the like, or part of the low-active chemical having been reacted in the gasification furnace 10 is separated in the particle classifier 40 and discharged together with ash for disposal.

Since such disposal of CaS or the like and partial low-active chemical results in lack of CaO or the like, $CaCO_3$ or the like corresponding to such lack is replenished (as newly added inactive chemical) in the form of mineral such as limestone from the chemical supply pipe **20*a* to the fluidized bed 22 of the combustion furnace 20**; thus, CaO or the like is continued to be satisfactorily generated.

As mentioned in the above, in the gasifier using the method for gasifying solid fuel with unified gas purification according to the invention, the whole gasification process is divided into three processes or phases: the gasification furnace 10 for fuel pyrolysis and gasification (pyrolysis gasification, first process), the combustion furnace 20 for burning the gasified char and for calcining chemical such as $CaCO_3$ to obtain active chemical such as CaO (char combustion, second process) and the gas purification furnace 30 for purification of the product gas (gasified gas purification, third process).

Thus, the temperatures of the respective furnaces may be readily controlled independently from each other. Especially in the gas purification furnace 30, owing to heat of the high-temperatured fluid heat medium and of the active chemical such as CaO circulated from the combustion furnace 20 and suitable for exhibition of the catalytic function by the active chemical to the tar reforming reaction, the fluidized bed 32 may be controlled to the reaction temperature T2 (for example, 1073 K or more), i.e., high temperature required for active CaO or the like to sufficiently exhibit the catalytic function to the tar reforming reaction; in the gasification furnace 10, in the presence of heat possessed by the fluid heat medium and CaO or the like circulated from the gas purification furnace 30, for example adjustment of the fuel amount fed to the gasification furnace 10 can be carried out to control the fluidized bed 12, suitable for $CO_2$ absorption chemical reaction by CaO, to the reaction temperature T3 (for example, 873-1023 K), i.e., the lower or medium temperature required for absorption chemical reaction of $CO_2$.

Thus, in the fluidized bed 22 in the combustion furnace 20, the fluid heat medium is heated and $CaCO_3$ or the like chemical is calcined to generate active chemical such as CaO, these fluid heat medium and CaO or the like are fed to the gas purification furnace 30; in the fluidized bed 32 in the furnace 30, at the predetermined reaction temperature T2, the product gas can be satisfactorily purified with CaO or the like being used as catalyst, so that tar, dust, $H_2S$, HCl and the like in the product gas can be satisfactorily removed. Moreover, in the fluidized bed 12 in the gasification furnace 10, at the predetermined reaction temperature T3 and at the predetermined low pressure (1-5 atm), $CO_2$ in the product gas generated through gasification can be satisfactorily absorbed by active chemical such as CaO, so that combustion heat amount possessed by the product gas can be enhanced and $H_2$ concentration in the product gas can be enhanced ($H_2$-enrichment) while gasifying reaction speed can be accelerated and further, heat supply for gasification (including fuel pyrolysis) can be stabilized.

That is, the action of absorbing $CO_2$ in the gas by the chemical to accelerate the gasifying reaction (including fuel pyrolysis) can be compatible with the catalytic action of reforming tar in the product gas generated through the gasifying reaction.

Thus, while enhancing the gasification efficiency as a whole, the product gas clean, with high quality and useable for various uses can be obtained.

As shown in FIG. 1 as option, part of the purified product gas may be returned to and charged together with the gasifying agent to the gasification furnace 10; then, heat of the product gas may be used for temperature control in the gasification furnace 10 to further stabilize heat supply for gasification (including fuel pyrolysis).

To maintain the temperature in the gasification furnace 10 at the low or medium temperature or predetermined reaction temperature T3 (for example, 873-1023 K) makes it possible to utilize various industrial waste heat (for example, exhaust gas from a gas turbine) as stable heat source for gasification (including fuel pyrolysis), contributing to constructing a highly effective system.

Embodiment 2

Next, a second embodiment will be described.

Figure 7:
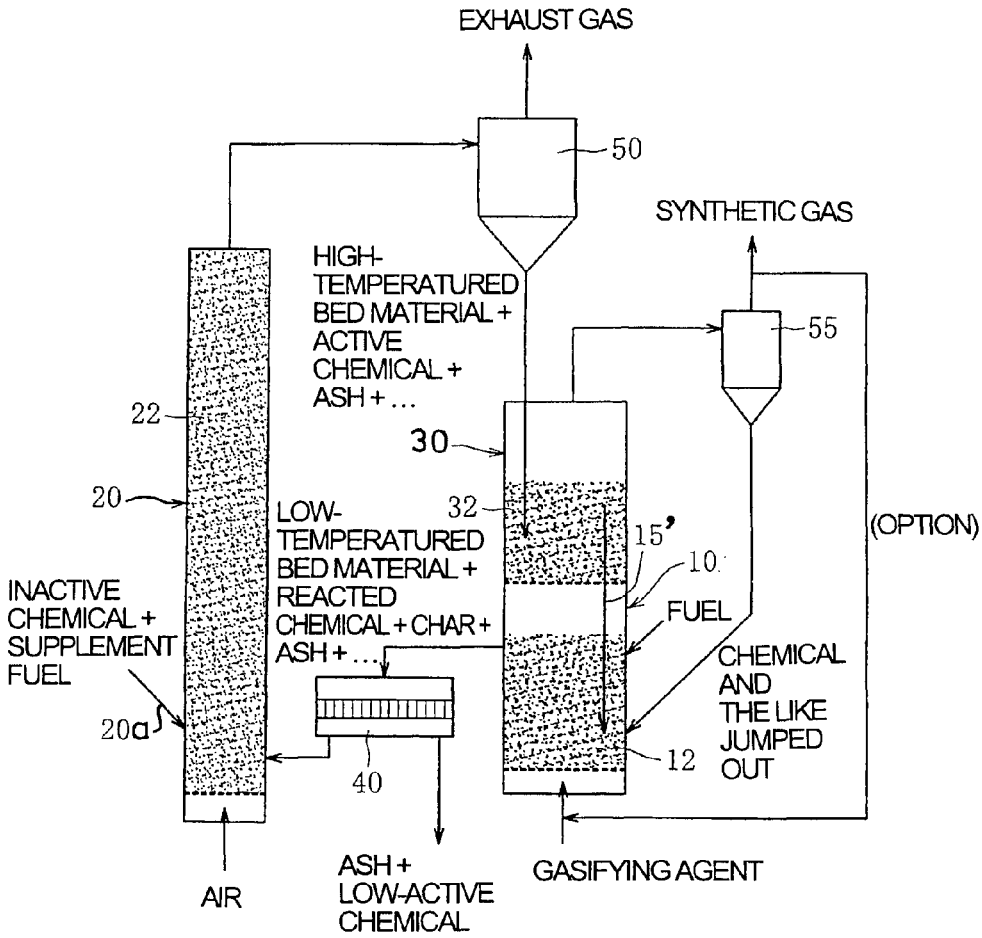
FIG. 7A view showing schematic construction of a gasifier for solid fuel with unified gas purification according to a second embodiment of the invention.

FIG. 7 shows schematic construction of a gasifier for solid fuel with unified gas purification according to the second embodiment of the invention. The description will be made in conjunction with FIG. 7. In this connection, explanation is omitted with respect to portions in common with the above-mentioned first embodiment.

In the second embodiment, the apparatus comprises a gasification furnace 10 and a gas purification furnace 30 which are vertically connected into an integral unit, calcined active chemical such as CaO and fluid heat medium being passed into the gasification furnace 10 through a particle pipage (particle passage) 15' arranged in the furnaces 30 and 10.

Such integral construction of the gasification furnace 10 with the gas purification furnace 30 can make the whole of the apparatus compact in size and stabilize transfer of the fluid heat medium and active chemical such as CaO to the gasification furnace 10, thereby further stabilizing heat supply for gasification.

As shown in FIG. 7 as option and as in the above, part of the product gas purified may be returned to and charged together with the gasifying agent to the gasification furnace 10.

Embodiment 3

Next, a third embodiment will be described.

Figure 8:
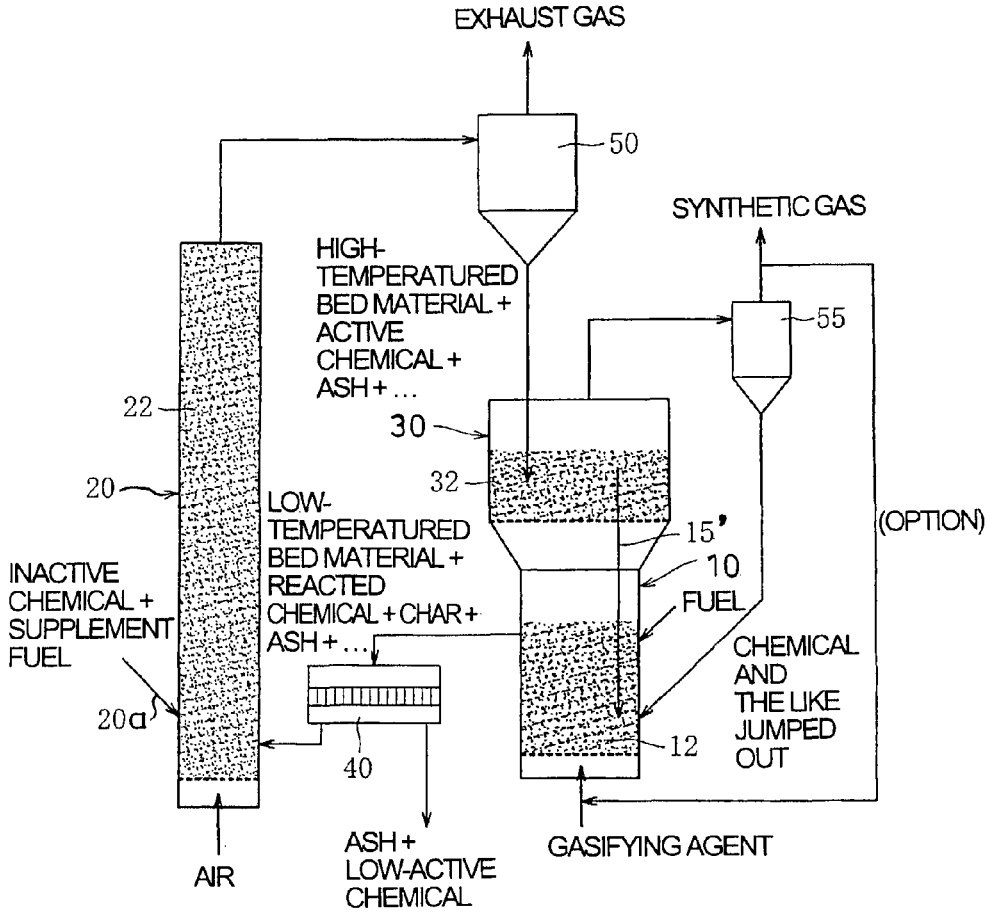
FIG. 8A view showing schematic construction of a gasifier for solid fuel with unified gas purification according to a third embodiment of the invention.

FIG. 8 shows schematic construction of a gasifier for solid fuel with unified gas purification according to the third embodiment of the invention. The description will be made in conjunction with FIG. 8. In this connection, explanation is made only on portions different from those in the above-mentioned second embodiment.

In the third embodiment, the apparatus comprises a gasification furnace 10 and a gas purification furnace 30 which are integrally constructed, a horizontal cross sectional area of the furnace 30 being larger than that of the furnace 10.

Such increased horizontal cross sectional area of the gas purification furnace 30 than that of the gasification furnace 10 prolongs dwell time of the product gas, which is generated in the gasification furnace 10, in the fluidized bed 32 of the gas purification furnace 30, so that the product gas is further satisfactorily purified during its passage through the furnace 30.

Thus, tar, dust, $H_2S$, HCl and the like in the product gas can be further reliably removed in comparison with the above-mentioned second embodiment, thereby further enhancing the purification effect of the product gas.

As shown in FIG. 8 as option and as in the above, part of the product gas purified may be returned to and charged together with the gasifying agent to the gasification furnace 10.

Embodiment 4

Next, a fourth embodiment will be described.

Figure 9:
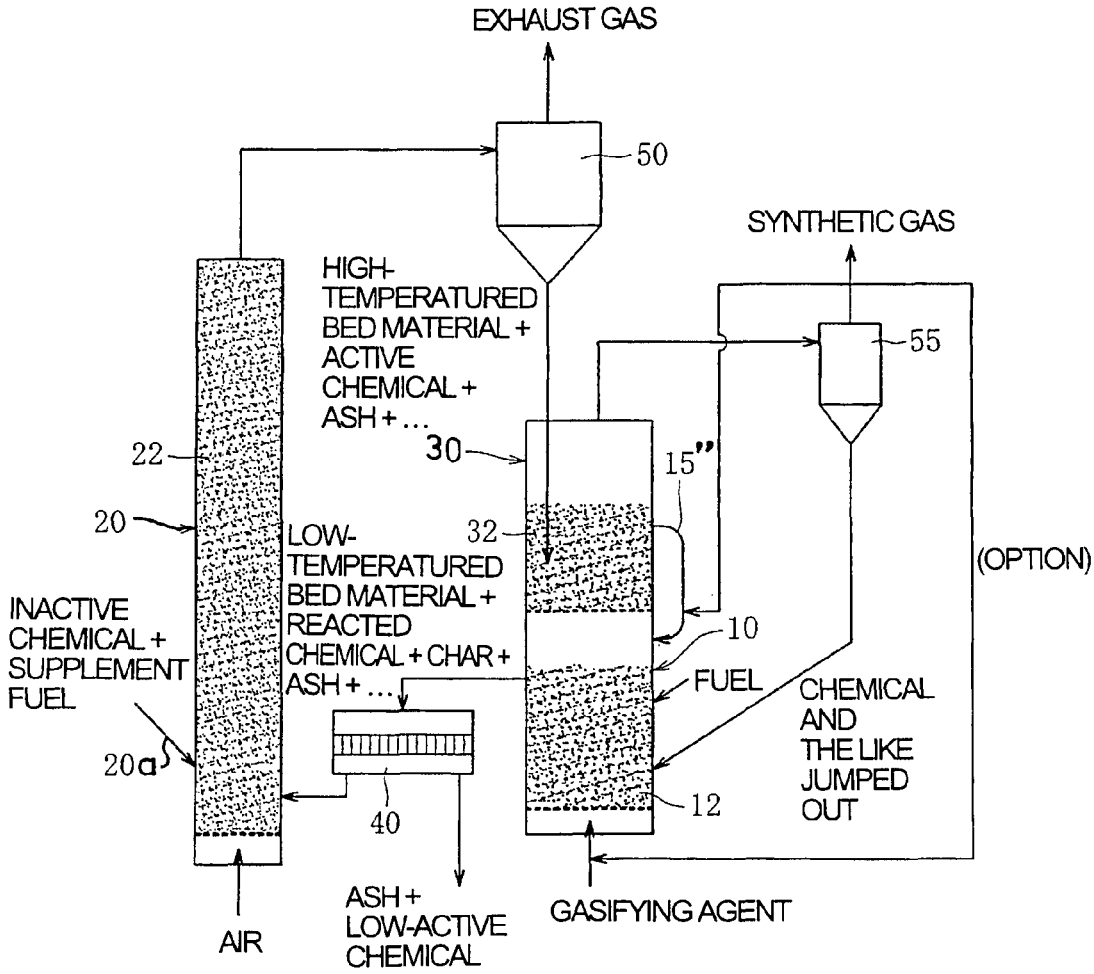
FIG. 9A view showing schematic construction of a gasifier for solid fuel with unified gas purification according to a fourth embodiment of the invention.

FIG. 9 shows schematic construction of a gasifier for solid fuel with unified gas purification according to the fourth embodiment of the invention. The description will be made in conjunction with FIG. 9. Also in this connection, explanation is made only on portions different from those in the above-mentioned second embodiment.

In the fourth embodiment, the apparatus comprises a gasification furnace 10 and a gas purification furnace 30 which are integrally constructed, a particle pipage (particle passage) 15" being provided as outer passage between the furnaces 30 and 10.

Such communication between the gas purification furnace 30 and the gasification furnace 10 through the particle pipage 15" or outer passage brings about supply of the active chemical such as CaO and the fluid heat medium from the gas purification furnace 30 via the particle pipage 15" to the gasification furnace 10. At this time, together with these fluid heat medium and active chemical, part of the product gas purified is fed to the particle pipage 15", whereby enhanced is the supply of particles such as the fluid heat medium and active chemical from the gas purification furnace 30 to the gasification furnace 10.

As a result, in comparison with the above-mentioned second embodiment, transfer of the fluid heat medium and active chemical such as CaO to the gasification furnace 10 can be further stabilized and heat supply for gasification can be further stabilized.

As shown in FIG. 9 as option and as in the above, part of the product gas purified may be returned to and charged together with the gasifying agent to the gasification furnace 10.

The description has been made with respect to the embodiments of the invention. It is to be understood that the invention is not limited to the above embodiments and that various changes and modifications may be made without leaving the scope and spirit of the invention.

For example, in the above embodiments, the description has been made with the chemical being limestone ($CaCO_3$) and the active chemical being CaO; however, the chemical may be mineral such as $Ca(OH)_2$ which has, as its basis, metal carbonate such as dolomite ($CaCO_3.MgCO_3$) or hydroxide; the active chemical may be MgO, CaO.MgO or the like.

With the above embodiments, the description has been made with respect to the system having outer circulation type fluidized bed; however, the invention is applicable also to a system with moving bed.

INDUSTRIAL APPLICABILITY

The invention can be effectively utilized when tar and $H_2S$ in gasified gas of solid fuel are to be easily and inexpensively removed, using natural mineral and to sufficiently purify the gasified gas.

The invention claimed is:

1. A method for gasifying solid fuel with unified gas purification, comprising:

feeding solid fuel and a gasifying agent to a first reactor for pyrolysis and gasification where said solid fuel is pyrolyzed in contact with a heat medium to generate char which is gasified by said gasifying agent, $CO_2$ in gasified gas generated by said pyrolysis and gasification being absorbed by an active chemical at a reaction temperature of 773-1073K;

feeding residual char which is not gasified in said first reactor for pyrolysis and gasification, the heat medium which is lowered in temperature by the pyrolysis and gasification of said solid fuel, the active chemical which is less-activated through the reaction with said $CO_2$ and newly added inactive chemical to a second reactor for char combustion where said char is burned by an oxidizing agent to bring about combustion heat of 1073K or more, said low-active and inactive chemicals are calcined to be re-activated and activated, respectively; and feeding the heat medium in said second reactor for char combustion heated to 1073K or more, the re-activated and activated chemicals and said gasified gas from said first reactor for pyrolysis and gasification to a third reactor for gasified gas purification where said chemicals function as catalyst to reform tar in said gasified gas at a reaction temperature which is lower than a reaction temperature in said second reactor for char combustion and higher than a reaction temperature of the first reactor for pyrolysis and absorbs $H_2S$ and HCl in said gasified gas to purify said gasified gas, the chemicals functioning as catalyst to purify said gasified gas circulated together with the heat medium to said first reactor for pyrolysis and gasification, wherein said first reactor and said third reactor are vertically connected into an integral unit, and said active chemical and said heat medium pass through a particle passage arranged in said first reactor and said third reactor into said first reactor.

2. A method for gasifying solid fuel with unified gas purification as claimed in claim 1, wherein the inactive chemical is a mineral with a base of metal carbonate or hydroxide.

3. A method for gasifying solid fuel with unified gas purification as claimed in claim 1, wherein a horizontal cross sectional area of said third reactor is larger than a horizontal cross sectional area of said first reactor.

4. A method for gasifying solid fuel with unified gas purification, comprising:

feeding solid fuel and a gasifying agent to a first reactor for pyrolysis and gasification where said solid fuel is pyrolyzed in contact with a heat medium to generate char which is gasified by said gasifying agent, $CO_2$ in gasified gas generated by said pyrolysis and gasification being absorbed by an active chemical at a reaction temperature of 773-1073K;

feeding residual char which is not gasified in said first reactor for pyrolysis and gasification, the heat medium which is lowered in temperature by the pyrolysis and gasification of said solid fuel, the active chemical which is less-activated through the reaction with said $CO_2$ and newly added inactive chemical to a second reactor for char combustion where said char is burned by an oxidizing agent to bring about combustion heat of 1073K or more, said low-active and inactive chemicals are calcined to be re-activated and activated, respectively; and feeding the heat medium in said second reactor for char combustion heated to 1073K or more, the re-activated and activated chemicals and said gasified gas from said first reactor for pyrolysis and gasification to a third reactor for gasified gas purification where said chemicals function as catalyst to reform tar in said gasified gas at a reaction temperature which is lower than a reaction temperature in said second reactor for char combustion and higher than a reaction temperature of the first reactor for pyrolysis and absorbs $H_2S$ and HCl in said gasified gas to purify said gasified gas, the chemicals functioning as catalyst to purify said gasified gas circulated together with the heat medium to said first reactor for pyrolysis and gasification, wherein said first reactor and said third reactor are vertically connected into an integral unit, and said active chemical and said heat medium pass through a particle passage arranged as an outer passage between said first reactor and said third reactor into said first reactor.

5. A method for gasifying solid fuel with unified gas purification as claimed in claim 4, wherein the inactive chemical is a mineral with a base of metal carbonate or hydroxide.

6. A method for gasifying solid fuel with unified gas purification as claimed in claim 4, wherein a horizontal cross sectional area of said third reactor is larger than a horizontal cross sectional area of said first reactor.

* * * * *